US006050620A

United States Patent [19]

Rogers, Jr. et al.

[11] Patent Number: 6,050,620

[45] Date of Patent: Apr. 18, 2000

[54] VEHICLE DOOR LATCH

[75] Inventors: Lloyd Walker Rogers, Jr., Shelby Township, Macomb County; Reginald Lee McDonald, Macomb Township, Macomb County, both of Mich.

[73] Assignee: General Motors Corporation, Detroit, Mich.

[21] Appl. No.: 09/106,543

[22] Filed: Jun. 29, 1998

[51] Int. Cl.[7] ..... E05C 3/06

[52] U.S. Cl. ..... 292/216; 292/336.3; 292/DIG. 23

[58] Field of Search ..... 292/216, DIG. 23, 292/DIG. 27, 336.3

[56] References Cited

U.S. PATENT DOCUMENTS

| | | | |
|---|---|---|---|
| 3,365,226 | 1/1968 | Shay | 292/216 |
| 3,384,404 | 5/1968 | Slattery | 292/216 |
| 3,545,800 | 12/1970 | Arlauskas | 292/216 |
| 3,563,589 | 2/1971 | Kwasiborski, Jr. | 292/216 |
| 4,969,673 | 11/1990 | Portelli et al. | 292/216 |
| 5,046,769 | 9/1991 | Rimbey et al. | 292/216 |
| 5,078,436 | 1/1992 | Kleefeldt et al. | 292/201 |
| 5,154,460 | 10/1992 | Bartsch | 292/336.3 |
| 5,277,461 | 1/1994 | Dzurko et al. | 292/216 |
| 5,427,421 | 6/1995 | Hamaguchi | 292/216 |

*Primary Examiner*—B. Dayoan
*Assistant Examiner*—John B. Walsh
*Attorney, Agent, or Firm*—Kathryn A. Marra

[57] ABSTRACT

A vehicle door latch has a locking mechanism and an unlatching mechanism that cooperate so that the door latch can be unlocked when the unlatching operation is initiated prematurely.

12 Claims, 5 Drawing Sheets

VEHICLE DOOR LATCH

TECHNICAL FIELD

This invention relates generally to a vehicle door latch and more particularly to a vehicle door latch that has a latching mechanism for operating the vehicle door latch and a locking mechanism for disabling the latching mechanism.

BACKGROUND OF THE INVENTION

An automotive closure, such as a door for an automobile passenger compartment, is hinged to swing between open and closed positions and conventionally includes a door latch that is housed between inner and outer panels of the door. The door latch functions in a well known manner to latch the door when it is closed and to lock the door in the closed position or to unlock and unlatch the door so that the door can be opened manually.

The door latch is operated remotely from the exterior of the automobile by two distinct operators—a key cylinder that controls the locking mechanism and an outside door handle or push button that controls the latching mechanism.

The door latch is also operated remotely from inside the passenger compartment by two distinct operators—a sill button that controls the locking mechanism and an inside door handle that controls the latching mechanism. Vehicle door latches for upscale automobiles may also include power door locks in which the locking mechanism is motor driven and/or a keyless entry in which a key fob transmitter sends a signal to a receiver in the vehicle to operate a motor driven locking mechanism.

U.S. Pat. No. 5,277,461 granted to Thomas A. Dzurko et al on Jan. 11, 1997 for a vehicle door latch, which is hereby incorporated in this patent specification by reference, discloses a typical door latch of the above-noted type. The door latch disclosed in the Dzurko '461 patent includes an unlatching lever 60 that is pivotally mounted on a stud 28 that is secured to a metal back plate 16 and a metal face plate 14 at opposite ends. Unlatching lever 60 is operated to unlatch the vehicle door by an inside handle lever 56 that is connected by a suitable linkage for rotation by an inside door handle (not shown). Unlatching lever 60 is also operated by an outside handle lever 50 that is connected by suitable linkage for rotation by an outside door handle (not shown).

The Dzurko door latch also includes a locking lever 40 that is pivotally mounted on stud 28. Locking lever 40 is operated by an inside locking lever 80 that is pivotally mounted on the flange of the metal face plate 14 near the inside handle lever 56. The inside locking lever 80 is operated by an inside sill button or lock slide through a suitable linkage (not shown). Locking lever 40 is also operated by an outside locking lever 82 that is operated by a key lock cylinder through a suitable linkage (not shown). In some instances, for example in upscale automobiles, locking lever 40 is also power operated by a remotely controlled linear electric motor or the like in a well known manner (not shown).

The door latch disclosed in the Dzurko '461 patent is unlocked and unlatched in the following sequence. First, the locking lever 40 is moved to the unlocked position by the inside locking lever 80, the outside locking lever 82 or, in the instance of a vehicle equipped with power door locks, a remotely-controlled motor. This moves the intermittent lever 34 to the unlocked position. After the door latch is unlocked, the door latch is unlatched by moving the unlatching lever 60 via inside handle lever 56 or outside handle lever 50 to the unlatched position pulling intermittent lever 44 and detent 32 down to unlatch the door lock. The vehicle door then may be pushed or pulled open manually.

Door latches of the type disclosed in the Dzurko '461 patent have been used successfully by General Motors Corporation for many years.

However, there are instances where driver or passenger impatience initiates the unlatching operation prematurely reversing the normal sequence of unlocking and then unlatching the door lock to enter or exit a locked vehicle. Of course, the door lock cannot be unlatched when in the locked condition. However, when the unlatching lever 60 moves to the unlatching position, the unlatching lever 60 blocks the intermittent lever 34 and prevents movement of the locking lever 40 to the unlocked position resulting in an impasse where the door lock cannot be unlocked or unlatched.

SUMMARY OF THE INVENTION

The object of this invention is to provide a vehicle door latch that has a locking mechanism and a latching mechanism that cooperate so that the door lock can be unlocked when the unlatching operation is initiated prematurely.

A feature of the vehicle door latch of the invention is that the vehicle door latch has a transfer lever that is movably attached to an unlatching lever to accommodate premature operation of the unlatching mechanism.

Another feature of the vehicle door latch of the invention is that the vehicle door latch has an intermittent lever for unlatching the door latch and a transfer member that drives the intermittent lever in an unlocking, unlatching operating sequence but yields to the intermittent lever when the unlatching operation is initiated prematurely to permit an unlocking operation.

Yet another feature of the vehicle door latch of the invention is that the vehicle door latch has a transfer member that pivots on an unlatching lever and either drives an intermittent lever or yields to the intermittent lever, depending upon the operating sequence of the door latch.

Still another feature of the vehicle door latch of the invention is that the vehicle door latch has a transfer member that pivots on an unlatching lever and a spring that biases the transfer member in position to drive an intermittent lever to unlatch the door latch.

Still yet another feature of the vehicle door latch of the invention is that the vehicle door latch has a transfer member that has a pivot pin that journals the transfer member on an unlatching lever and engages an outside handle lever for driving an intermittent lever by the outside handle lever.

These and other objects, features and advantages of the invention will become apparent from the description below, which is given by way of example with reference to the accompanying drawings.

DESCRIPTION OF THE PREFERRED EMBODIMENT

The Prior Art Door Latch

Figure 1:
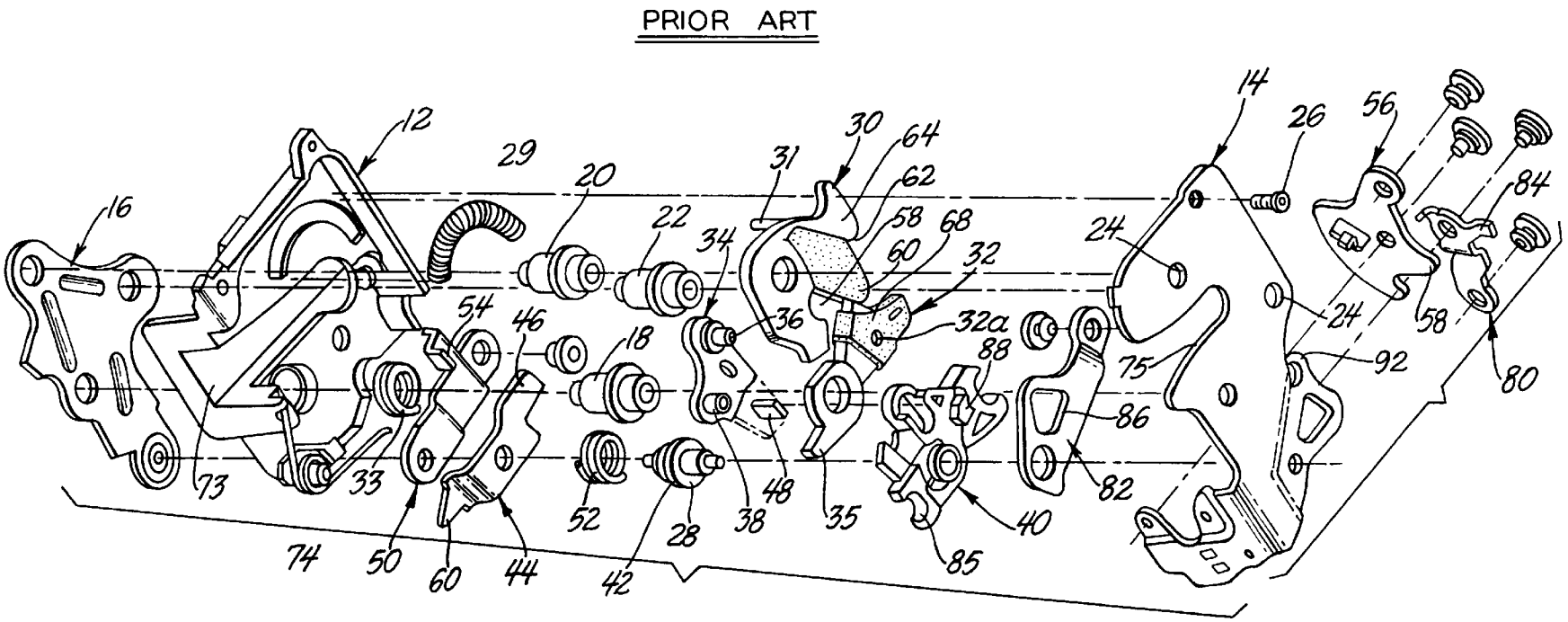
FIG. 1 is an exploded perspective front view of a prior art vehicle door latch.

Referring now to FIG. 1, the prior art vehicle door latch 10 has a multi-piece enclosure that comprises plastic housing 12, metal face plate 14 and metal back plate 16. The plastic housing 12 and the metal back plate 16 are held together by three flanged, internally threaded bushings 18, 20 and 22 that are inserted into three holes in the plastic housing 12, then through three aligned holes in the back plate 16 and then flanged over the back plate. The metal face plate 14 has three bolt holes 24 that are aligned with the bushings 18, 20 and 22 when the metal face plate is attached to the plastic housing 12 by a screw 26. The metal face plate 14 and the metal back plate 16 have lower portions below the plastic housing 12 that are held together by a flanged stud 28 that has projecting pins at each end that are inserted in holes in the plates and peened or headed over.

The Prior Art Latch Mechanism

The latch mechanism of the prior art vehicle door latch 10 comprises a fork bolt 30 and a cooperating detent 32 that are pivotally mounted on bushings 20 and 18, respectively, and located in a chamber of the plastic housing 12 behind the metal face plate 14. The fork bolt 30 is biased clockwise by a coil spring 29. Coil spring 29 is disposed in a curved slot in the plastic housing 12 behind the fork bolt 30, and it engages a depending pin 31 of the fork bolt 30 at one end. Detent 32 is biased counterclockwise into engagement with the fork bolt 30 by a coil spring 33 that surrounds the bushing 18 and that has one end engaging an ear 35 of the detent 32. Detent 32 engages and holds the fork bolt lever 30 in a primary latched position against the bias of spring 29 as shown in FIG. 1. Detent 32 also can engage fork bolt 30 at 62 and hold it in an intermediate secondary latched position. Detent 32 engages fork bolt 30 at foot 64 in its unlatched position.

The latching mechanism further comprises an intermittent lever 34 for operating the detent 32. The intermittent lever 34 is located in the chamber of the plastic housing 12 behind detent 32. It has two integral pivot pins 36 and 38. Pivot pin 36 is journalled in a hole 32*a* in detent 32 so that the detent 32 rotates clockwise from the position shown in FIG. 1 (and out of latched engagement with the fork bolt 30) to the unlatched position when the intermittent lever 34 is pulled down. The pivot pin 38 is disposed in a slot of a locking lever 40 that pivots the intermittent lever 34 counterclockwise about pivot pin 36 from the unlock position shown in FIG. 1 to a lock position (not shown). The locking lever 40 is journalled on the stud 28 between the flange 42 and the face plate 14. Briefly, the locking lever 40 is rotated clockwise to lock the door latch 10 or counterclockwise to unlock the door latch. Clockwise rotation pivots intermittent lever 34 counterclockwise about pivot pin 36 to a position where it is uncoupled from and out of the path of travel of unlatching lever 44 as described below. A more complete description of the locking lever 40 and lock mechanism is given after the latching mechanism is described.

The latch mechanism further comprises unlatching lever 44 that is journalled on a reduced diameter portion of the stud 28 spaced rearwardly of the flange 42. The unlatching lever 44 has an ear 46 at one end that is engageable with an integral, rearwardly projecting tab 48 of the intermittent lever 34 so that the intermittent lever 34 is pulled down when the transfer lever 44 is rotated clockwise as viewed in FIG. 1.

The latch mechanism further comprises an outside handle lever 50 and a coil return spring 52. Handle lever 50 is also journalled on the reduced diameter portion of the stud 28 behind the unlatching lever 44. It has a bent tab 54 that engages the ear 46 of the unlatching lever 44 so that the outside handle lever 50 rotates the unlatching lever 44 clockwise when it is rotated clockwise on stud 28. Outside handle lever 50 is connected by suitable linkage for rotation by an outside door handle (not shown).

The coil return spring 52 is disposed around the stud 28 and located between the flange 42 and the unlatching lever 44. One end of the coil spring 52 engages the bottom of unlatching lever 44 and the other end engages the bottom of the plastic housing 12 above the unlatching lever 44 so that unlatching lever 44 and outside handle lever 50 are biased counterclockwise to a rest position where tab 54 engages the bottom of the plastic housing 12.

The latch mechanism further comprises an inside handle lever 56 that is pivotally mounted on a flange 15 of the metal face plate 14. Inside handle lever 56 has a tab 58 that engages a second ear 60 of unlatching lever 44 so that inside handle lever 56 also rotates unlatching lever 44 clockwise when it is rotated counterclockwise. Inside handle lever 56 is connected by suitable linkage for rotation by an inside door handle or other operator (not shown).

Fork bolt 30 has a conventional slot or throat 58 for receiving and retaining a strike member that is attached to the vehicle door pillar to latch the vehicle door in the closed position (not shown). Fork bolt 30 also includes a primary latch shoulder 60, an intermediate secondary latch shoulder 62 and a radially projecting foot 64. Fork bolt 30 preferably has a plastic coating that covers a surface of the slot 58 that is engaged by the striker for energy absorption and quiet operation when the vehicle door is slammed shut.

Detent 32 has a sector shaped catch 68 that engages the radially projecting foot 64 when the fork bolt 30 is in the unlatched position (not shown). The sector shaped catch 68 positively engages the primary and secondary latch shoulders 60 and 62 to hold the fork bolt 30 in either the primary or the intermediate secondary latched positions shown in FIG. 1 and not shown, respectively. Detent 32 also preferably includes a plastic coating that has an integral bumper. The bumper engages the bushing 22 to stop counterclockwise pivoting of the detent lever 32 under the bias of spring 52. This bumper also absorbs energy and quiets operation when the door is slammed shut.

The latch mechanism described above operates as follows. When the door latch 10 is in an unlatched and unlocked condition, fork bolt 30 is poised to receive a conventional strike member (not shown) that projects into aligned fish mouth slots 73 and 75 of the plastic housing 12 and the metal face plate 14 when the door is shut. The entering strike member engages the plastic coating at the back of the throat 58 and rotates fork bolt 30 counterclockwise against the bias of spring 29 until fork bolt 30 is rotated to the primary latch position shown in FIG. 1 where fork bolt 30 captures the striker in the throat 58. Fork bolt 30 is held in the primary latch position by catch 68 of detent 32 engaging the primary latch shoulder 60 of fork bolt 30.

Catch 68 rides along the periphery of the fork bolt 30 under the bias of spring 52 as fork bolt 30 rotates counterclockwise from the unlatched position to the primary latch position shown in FIG. 1. During this travel, catch 68 rides under the foot 64 into engagement with the intermediate secondary latch shoulder 62 and then under the coated portion into engagement with the primary latch shoulder 60. It is to be noted that the engagement of catch 68 with the intermediate secondary latching shoulder 62 is sufficient to hold the vehicle door closed in the event that the vehicle door is not shut with sufficient force so that catch 68 engages primary latch shoulder 60.

The vehicle door latch 10 is now latched but not locked so that the vehicle door can be opened simply by operating either an inside or outside door handle or the like to rotate the unlatching lever 44 clockwise moving the ear 46 down as viewed in FIG. 1. Ear 46 engages projection 48 of intermittent lever 34 and pulls the intermittent lever 34 down from the primary latch position shown in FIG. 1. As the intermittent lever 34 is pulled down, it rotates detent 32 clockwise against the bias of spring 52 from the primary latch position shown in FIG. 1. Fork bolt 30 is then free to rotate counterclockwise under the bias of spring 29 from the primary latch position shown in FIG. 1 to an unlatched position as the striker is pulled out of the aligned fishmouth slots 73 and 75 when the vehicle door is opened.

The Prior Art Lock Mechanism

The lock mechanism of door latch 10 is actuated by rotating the locking lever 40 that is journalled on stud 28 between flange 42 and face plate 14 clockwise. Clockwise rotation of the locking lever 40 rotates intermittent lever 34 counterclockwise about the pivot pin 36 that is journalled in the detent 32 due to the engagement of the second pivot pin 38 of the intermittent lever 34 in the slot of the locking lever. Intermittent lever 34 is thus rotated counterclockwise from the unlocked position shown in FIG. 1 to an locked position where projection 48 is repositioned out from under ear 46 of unlocking lever 46. Consequently, when the door handles or the like are operated so as to rotate the unlatching lever 44 clockwise to the unlatching position, the ear 46 simply bypasses the projection 48 without transferring any motion to the intermittent lever 34. Consequently, intermittent lever 34 is not pulled down to rotate detent 32 to the unlatch position. In other words, the unlatching lever 44 simply free wheels so that operation of the door handles or their equivalent is not effective.

The lock mechanism further comprises an inside locking lever 80 and an outside lock lever 82. Inside locking lever 80 is pivotally mounted on flange 15 of the metal face plate 14 at a location spaced from the pivot for the inside handle lever 56. Inside locking lever 80 has an ear 84 that fits in a slot 90 at one end of locking lever 40. Outside locking lever 82 is pivotally mounted on stud 28 in front of locking lever 40. Locking lever 40 has a protuberance 88 that projects through a sector shaped hole 86 in outside locking lever 82 and then through a smaller sector shaped hole 90 in face plate 14.

Protuberance 88 and sector shaped hole 90 limit rotation of locking lever 40 from an unlocked position shown in FIG. 1 where protuberance 88 engages the upper edge of hole 90 to a locked position (not shown) where protuberance 88 engages the lower edge of hole 90.

Locking lever 40 is rotated clockwise from the unlocked position shown in FIG. 1 to the locked position by rotating inside locking lever 80 counterclockwise as viewed in FIG. 1. Inside locking lever 80 is actuated by a suitable linkage system (not shown) for rotation by an inside sill button or other operator (not shown).

Locking lever 40 can also be rotated clockwise from the unlocked position shown in FIG. 1 to the locked position by rotating outside locking lever 82 clockwise. Outside locking lever 82 is generally actuated by a key lock cylinder through a suitable linkage (not shown). Outside locking lever 82 is an optional member that may be omitted in rear door applications that do not have a lock cylinder. Locking lever 40 also has a slot 85 for operating the locking lever 40 by power, for instance by a linear electric or vacuum motor.

The Prior Art Unlocking and Unlatching Sequence

Figure 2:
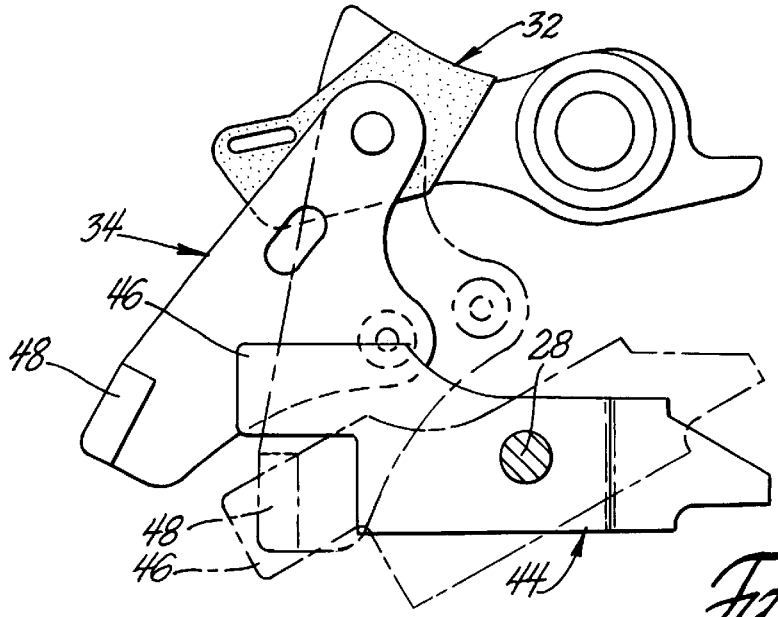
PRIOR ART Fig. 2
FIG. 2 is a fragmentary rear view of the prior art vehicle door latch shown in FIG. 1.

When locked, vehicle door latch 10 is unlocked and then unlatched as follows. Locking lever 40 is first rotated counterclockwise to the position shown in FIG. 1 which moves tab 48 of intermittent lever 34 beneath ear 46 of unlatching lever 60. Door latch 10 is then unlatched by rotating unlatching lever 44 clockwise to pull intermittent lever 34 down and release detent 32 from lock bolt 30. This unlocking/unlatching sequence must be followed because premature operation of unlatching lever 44 blocks intermittent lever 34 in the locked position if unlatching lever 44 is actuated first. FIG. 2 shows the locked position of intermittent lever 34 and the latched position of unlatching lever 44 in solid lines. The unlocked position of intermittent lever 34 and the unlatched position of unlatching lever 44 is shown in phantom. If unlatching lever 44 is rotated to the unlatched position prematurely shown in phantom in FIG. 2, the end of ear 46 lies in the path of movement of tab 48 of intermittent lever 34 from the locked position shown in solid lines to the unlocked position shown in phantom in FIG. 2. Hence, intermittent lever 34 cannot be pivoted to the unlocked position shown in solid line in FIG. 1 and in phantom in FIG. 2.

The Vehicle Door Latch of the Invention

The vehicle door latch 100 of the invention is shown in FIGS. 3 through 8. Vehicle door latch 100 includes essentially all of the components described above in connection with door latch 10 except for replacement of unlatching lever 44 and outside handle lever 50 that are pivotally mounted on stud 28. The remaining components of door latch 10 and door latch 100 are substantially identical except for the elimination of interlock projection 90 in vehicle door latch 100. Corresponding components are identified with the same numerals in FIGS. 1, 2 and 3 through 8.

Inside handle lever 56, inside locking lever 80 and outside locking lever 82 are not shown in FIGS. 3–8 in the interest of clarity. The relationship and operation of these parts is clear from the prior art door latch 10 shown in FIG. 1.

Figure 3:
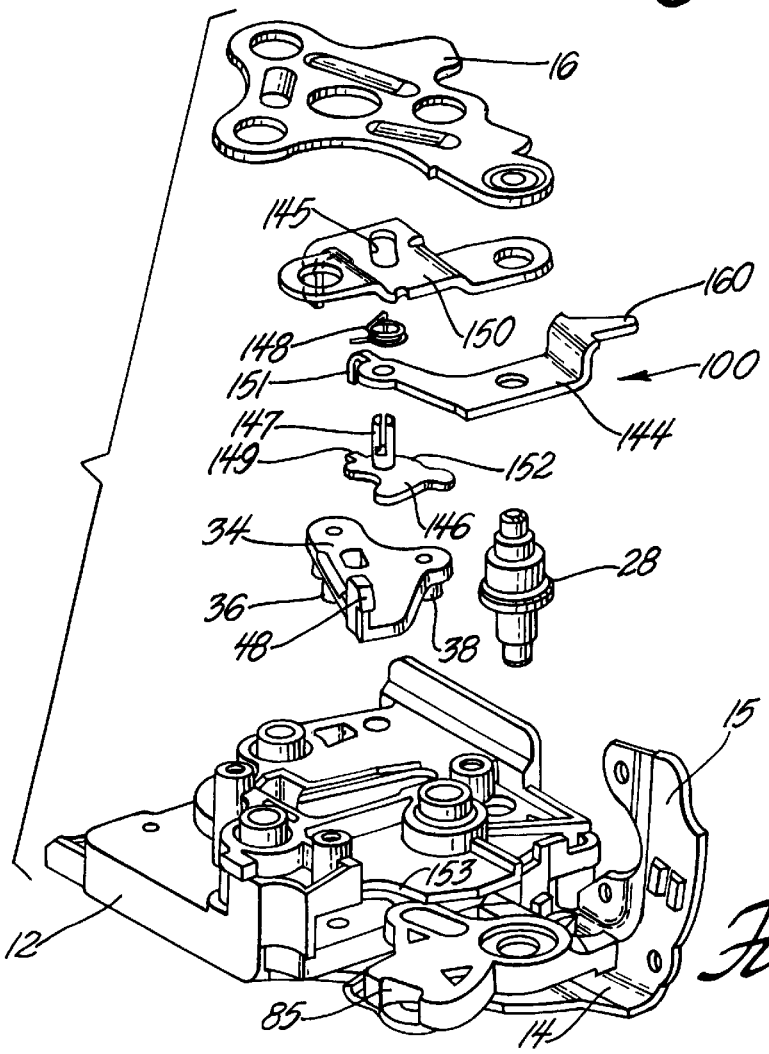
FIG. 3 is a partially exploded, perspective rear view of a vehicle door latch in accordance with the invention.

Referring now to FIG. 3, vehicle door latch 100 comprises an unlatching lever 144, a transfer member 146, a coil spring 148 and an outside handle lever 150 in place of the prior art unlatching lever 44 and outside handle lever 50. Unlatching lever 144 and outside handle lever 150 are pivotally mounted on stud 28. Transfer member 146 pivots on unlatching lever 144 by means of an integral pin 147 that extends through a journal hole in an elevated end of the unlatching lever 144 and into a slot 145 of outside handle lever 150.

Unlatching lever 144 is generally horizontal in the latched position and transfer member 146 hangs vertically from the elevated end of unlatching lever 144. Coil spring 148 surrounds pin 147 and is located between unlatching lever 144 and outside handle lever 150. Coil spring 148 has one end anchored in a slot of pin 147 and the other end engaging a stop tab 151 of unlatching lever 144 so that spring 148 biases transfer member 146 counterclockwise away from stud 28 until stop tab 149 engages stop tab 151 of unlatching lever 144. Transfer member 146 includes a cam surface 152 that cooperates with surfaces 153 of housing 12 as explained below.

The Conventional Unlocking and Unlatching Sequence

Door latch 100 unlocks and unlatches essentially as described in connection with door latch 10, the only difference being that the unlatching lever 144 pushes down on tab 48 of intermittent lever 34 through the transfer member 146, which is vertically positioned by spring 148. Moreover, transfer member 146 is preferably shaped so that tab 48 torques transfer member 146 counterclockwise against stop tab 151 when tab 48 is pushed down.

Unlocking After a Premature Unlatching Operation

Door latch 100 also accommodates a premature unlatching operation which will now be explained in connection with FIGS. 4, 5 and 6.

Figure 4:
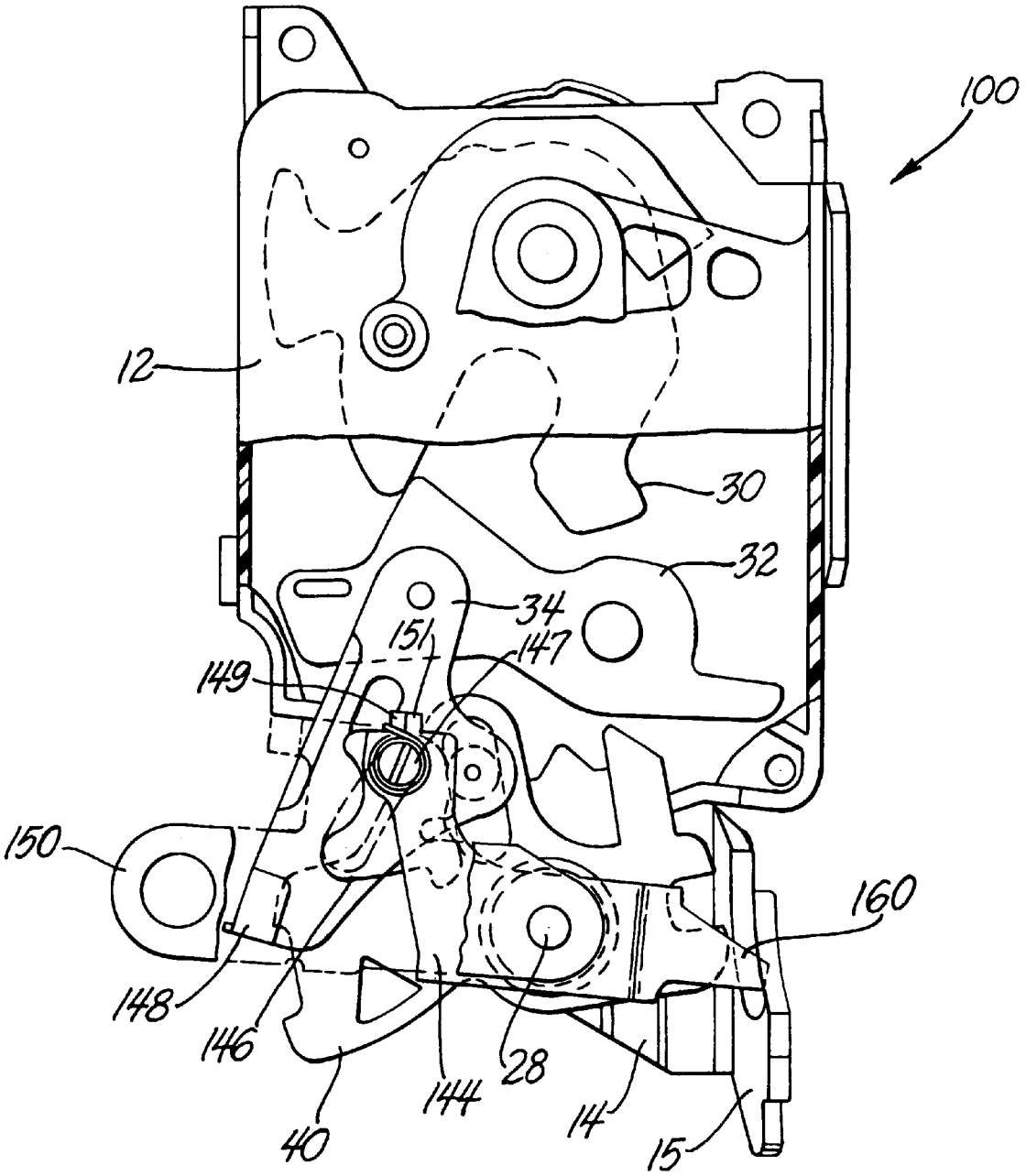
FIG. 4 is a fragmentary rear view of the vehicle door latch of FIG. 3 showing various parts in position when the vehicle door latch is latched and locked
Figure 5:
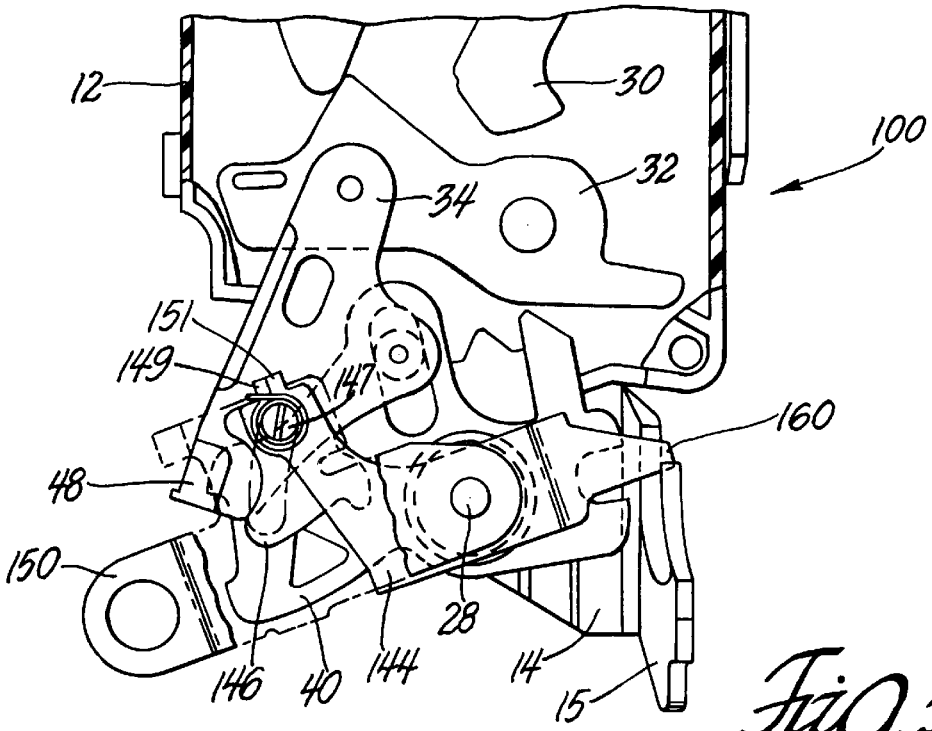
FIG. 5 is a fragmentary rear view of the door latch of FIG. 3 showing the parts in position when the vehicle door latch is locked and an unlatching operation is undertaken prematurely.

FIG. 4 is a fragmentary view of the door latch 100 in an installed position in a vehicle door, with the door latch in a latched and locked condition. Unlatching lever 144 responds to an unlatching operation by rotating counterclockwise from the latched position shown in FIG. 4 to the unlatched position shown in FIG. 5 bypassing tab 48 of intermittent lever 34. Transfer member 146 also bypasses tab 48 so that the vehicle door remains latched. (For the unlatching operation, either inside handle lever 56 rotates unlatching lever 144 via tab 160 or outside handle lever 150 rotates unlatching lever 144 via pin 147.)

If unlatching lever 144 is released, door latch 100 may then be unlocked and unlatched in the conventional sequence described above. However, door latch 100 may still be unlocked when the unlatching lever 144 is operated prematurely, that is, before the locking lever 40 moves the intermittent lever 34 to the unlocked position, and held in the unlatched position shown in FIG. 5. Under these circumstances, locking lever 40 is rotated clockwise from the locked position shown in FIG. 5 to the unlocked position shown in FIG. 6 by inside locking lever 80, outside locking lever 82 or the power door lock motor (not shown). Locking lever 40 in turn rotates intermittent lever 34 counterclockwise to the unlocked position shown in FIG. 6. As intermittent lever 34 rotates clockwise to the unlocked position, tab 48 of intermittent lever 34 engages transfer member 146 and rotates transfer member 146 counterclockwise against the action of coil spring 148. Door latch 100 is now unlocked but not unlatched.

The Rearming and Unlatching Operation

Figure 6:
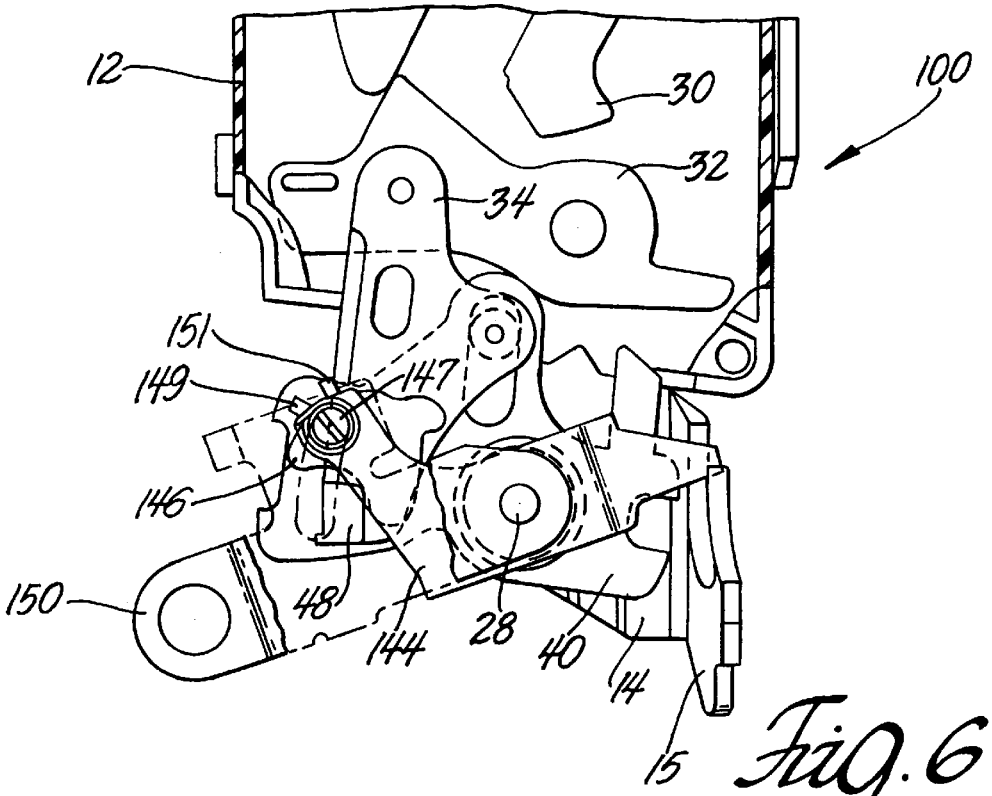
FIG. 6 is a fragmentary rear view of the door latch of FIG. 3 showing the parts in position when the vehicle door latch is unlocked after the premature unlatching operation.

Once unlocked, as shown in FIG. 6, door latch 100 can now be unlatched by rearming and then operating the latch mechanism. First, unlatching lever 144 is released by releasing and/or operating either the inside or the outside door handle. Upon release, unlatching lever 144 rotates clockwise under the bias of coil spring 52 and returns to the latched position shown in FIG. 7. As unlatching lever 144 returns to the generally horizontal latched position, transfer member 146 rotates counterclockwise on unlatching lever 144 and returns to the generally vertical position under the action of coil spring 148. Unlatching lever 144 and transfer member 146 are now armed and positioned to unlatch door latch 100. (In this regard, it should be noted that door latch 100 preferably includes a backup in the form of cam surface 152 that cooperates with surfaces 153 of housing 12 to return transfer member 146 to the armed position in the event that spring 148 fails.)

Figure 8:
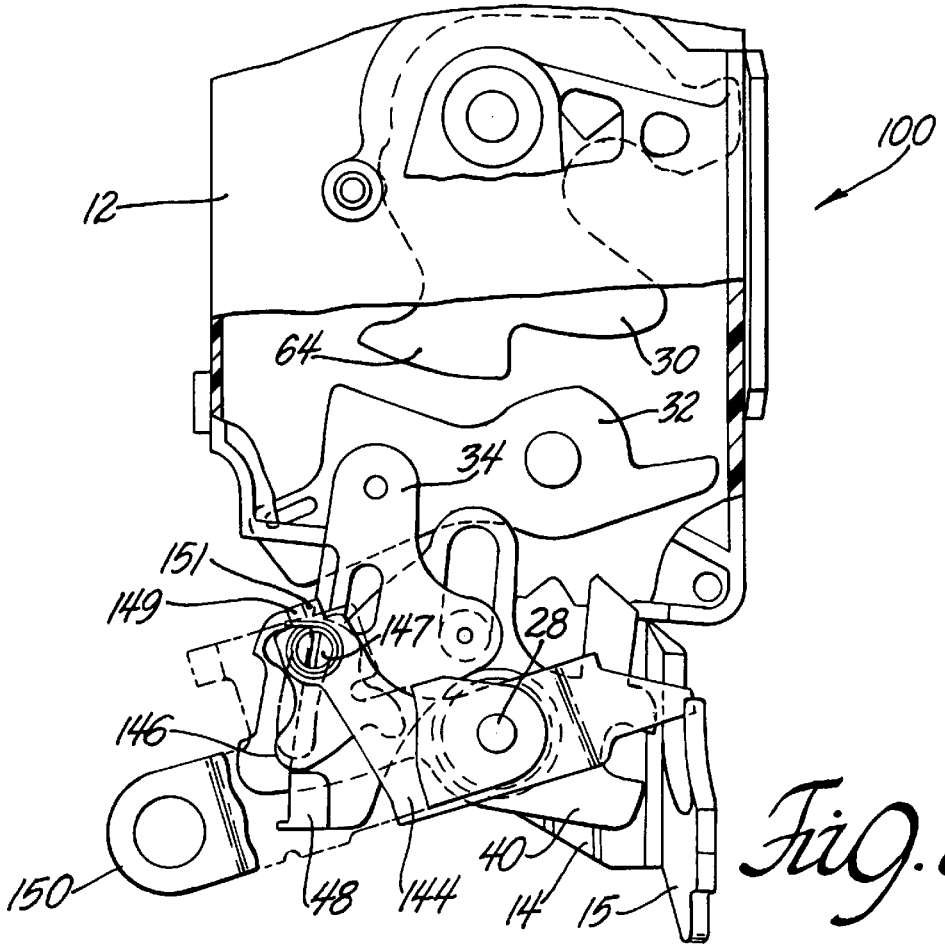
FIG. 8 is a fragmentary, rear view of the door latch of FIG. 3 showing the parts in position when the door latch is unlocked and unlatched.

The rearmed door latch 100 may then be unlatched by rotating unlatching lever 144 counterclockwise to the unlatched position shown in FIG. 8. When unlatching lever 144 rotates counterclockwise, transfer member 146 engages tab 48 and pulls intermittent lever 34 down to the unlatched position shown in FIG. 8. When intermittent lever 34 is pulled down, fork bolt 30 is released as described in connection with door latch 10 and the vehicle door may be pushed or pulled open, rotating fork bolt 30 to the unlatched position shown in FIG. 8.

Figure 7:
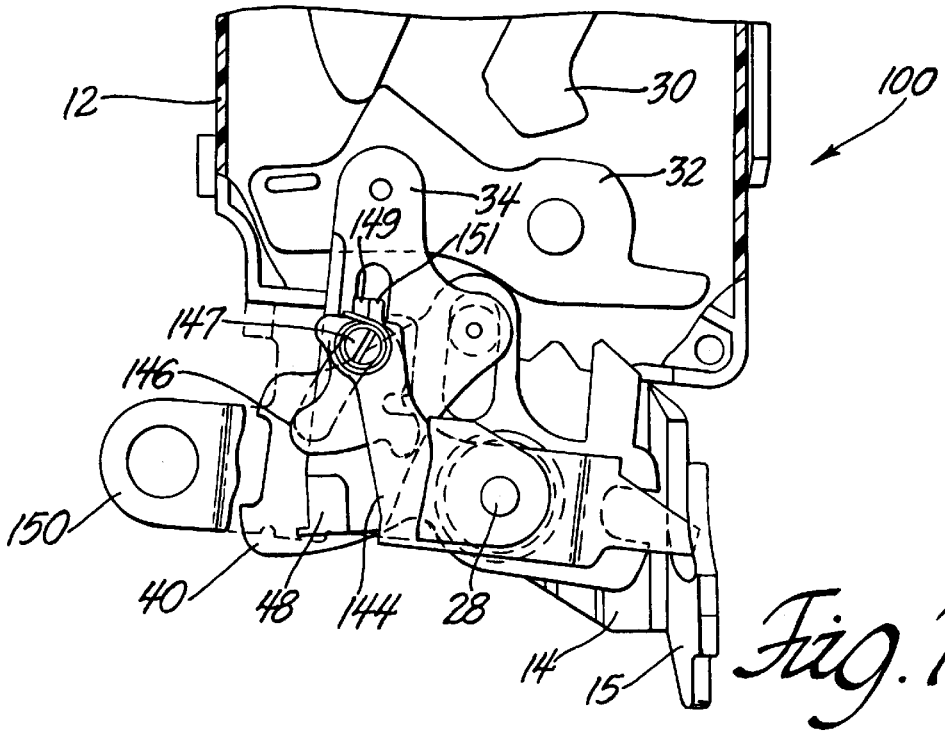
FIG. 7 is a fragmentary rear view of the door latch of FIG. 3 showing the parts in position when the vehicle door latch is unlocked and latched.

When unlatching lever 144 is released, detent 32 engages foot 64 of lock bolt 30, moving intermittent lever 34, transfer lever 146, unlatching lever 144 and outside handle lever 150 toward the latched position shown in FIG. 7. When the vehicle door is slammed shut, fork bolt 30 is rotated to the latched position and the internal parts of door latch 100 return to the latched, unlocked position shown in FIG. 7. Door latch 100 can then be locked by rotating locking lever 40 and intermittent lever 34 to the locked position shown in FIG. 4.

Thus, door latch 100 can be unlocked and then unlatched even if the latch mechanism is operated prematurely and held in the unlatched condition for a substantial amount of time.

Many modifications and variations of the present invention in light of the above teachings may be made. It is, therefore, to be understood that, within the scope of the appended claims, the invention may be practiced otherwise than as specifically described.

We claim:

1. A vehicle door latch having a locking mechanism and a latching mechanism comprising:

the locking mechanism including an intermittent lever for unlatching the door that moves between a locked position and an unlocked position and that moves between a latched position and an unlatched position when in the unlocked position, the latching mechanism including an unlatching lever that moves between a latching position and an unlatched position and a transfer member that is moveably mounted on the unlatching lever, the transfer member engaging the intermittent lever and moving the intermittent lever to the unlatched position when the unlatching lever is moved to the unlatched position and the intermittent lever is in the unlocked position the transfer member bypassing the intermittent lever when unlatching lever is moved to the unlatched position and the intermittent lever is in the locked position, and the intermittent lever engaging and moving the transfer member when the intermittent lever is moved to the unlocked position and the unlatching lever is in the unlatching position whereby the door latch may be unlocked with the unlatching lever held in the unlatching position.

2. The vehicle door latch according to claim 1 wherein the transfer member pivots on the unlatching lever.

3. The vehicle door latch according to claim 1 wherein the unlatching lever is generally horizontal when in the latching position and wherein the transfer member pivots on an elevated end of the unlatching lever.

4. The vehicle door latch according to claim 3 wherein the transfer member is spring biased to an armed position on the unlatching lever for engaging and moving the intermittent lever and moved to a disarmed position by the intermittent lever when the intermittent lever is moved to the unlocked position and the unlatching lever is in the unlatching position.

5. The vehicle door latch according to claim 4 wherein the transfer member has a cam surface that cooperates with a housing surface to move the transfer member to an armed position on the unlatching lever for engaging and moving the intermittent lever.

6. An automotive vehicle door latch according to claim 4 wherein the intermittent lever has a tab that is engaged by the transfer member to move the intermittent lever to the unlatched position and that engages the transfer member to move the transfer member when the intermittent member is moved to the unlocked position with the unlatching lever in the unlatched position.

7. A vehicle door latch having a locking mechanism and a latching mechanism comprising:

the locking mechanism including an intermittent lever for unlatching the door that moves between a locked position and an unlocked position and that moves between a latched position and an unlatched position when in the unlocked position, the latching mechanism including an unlatching lever that pivots between a latching position and an unlatching position and a transfer member that is pivotally mounted on the unlatching lever, the transfer member engaging the intermittent lever and moving the intermittent lever to the unlatched position when the unlatching lever is pivoted to the unlatched position and the intermittent lever is in the unlocked position the transfer member bypassing the intermittent lever when unlatching lever is pivoted to the unlatched position and the intermittent lever is in the locked position, and the intermittent lever engaging and moving the transfer member when the intermittent lever is moved to the unlocked position and the unlatching lever is in the unlatching position whereby the door latch may be unlocked with the unlatching lever held in the unlatching position.

8. The vehicle door latch according to claim 7 wherein the transfer member is pivoted on the unlatching lever by a pin of the transfer member that engages a slot in a handle lever for pivoting the unlatching lever to the unlatching position by the handle lever.

9. The vehicle door latch according to claim 8 further including a coil spring surround the pin that biases the transfer member to an armed position on the unlatching lever for engaging and moving the intermittent lever, the transfer member being moved to a disarmed position against the bias of the coil spring by the intermittent lever when the intermittent lever is moved to the unlocked position and the unlatching lever is in the unlatching position.

10. The vehicle door latch according to claim 9 wherein the transfer member has a stop tab that engages a stop tab of the unlatching lever when the transfer member is biased to the armed position.

11. The vehicle door latch as defined in claim 10 wherein the transfer member is shaped so that the transfer member is torqued to the armed position against the stop tab of the unlatching lever when the transfer member engages the intermittent lever and moves the intermittent lever to the unlatched position.

12. An automotive vehicle door latch according to claim 11 wherein the intermittent lever has a tab that is engaged by the transfer member to move the intermittent lever to the unlatched position and that engages the transfer member to move the transfer member when the intermittent member is moved to the unlocked position with the unlatching lever in the unlatched position.

* * * * *